US012594474B2

(12) United States Patent
Luo

(10) Patent No.: US 12,594,474 B2
(45) Date of Patent: Apr. 7, 2026

(54) PORTABLE SOCCER TRAINING DEVICE

(71) Applicant: Tri-Great International LTD., Dongguan (CN)

(72) Inventor: Chunfang Luo, Donguan (CN)

(73) Assignee: Tri-Great International LTD., Dongguan (CN)

( * ) Notice: Subject to any disclaimer, the term of this patent is extended or adjusted under 35 U.S.C. 154(b) by 380 days.

(21) Appl. No.: 18/515,405

(22) Filed: Nov. 21, 2023

(65) Prior Publication Data

US 2025/0114682 A1 Apr. 10, 2025

(30) Foreign Application Priority Data

Oct. 10, 2023 (CN) ..... 202322725248.1

(51) Int. Cl.
*A63B 69/00* (2006.01)

(52) U.S. Cl.
CPC ..... *A63B 69/0097* (2013.01); *A63B 69/002* (2013.01); *A63B 2210/54* (2013.01)

(58) Field of Classification Search
CPC ..... A63B 69/0097; A63B 69/002; A63B 2210/54; A63B 2063/001; A63B 2210/50
USPC ..... 473/421, 422, 434, 435, 446, 454–456, 473/477, 478
See application file for complete search history.

(56) References Cited

U.S. PATENT DOCUMENTS 1,689,475 A * 10/1928 Brumder ..... A63B 57/357 473/192
4,221,318 A * 9/1980 Giusti ..... B65H 19/1831 226/195
8,647,221 B1 * 2/2014 Hochberg ..... A63B 69/002 473/422
2003/0236139 A1 * 12/2003 Jensen ..... A63B 69/0002 473/434
2005/0192125 A1 * 9/2005 Valliquette ..... A63B 63/00 473/446
2008/0032826 A1 * 2/2008 Mubarak ..... A63B 63/004 473/446
2010/0125009 A1 * 5/2010 Goldwitz ..... A63B 63/004 473/476
2013/0344996 A1 * 12/2013 Adema ..... A63B 69/002 473/422

* cited by examiner

*Primary Examiner* — Nini F Legesse
(74) *Attorney, Agent, or Firm* — Hemisphere Law, PLLC

(57) ABSTRACT

A soccer training device includes a frame body, a rebound plate detachably connected to a side of the frame body, the rebound plate is composed of rebound battens sequentially arranged, and each rebound batten defines at least one webbing slot penetrating through the rebound batten. A webbing passing through the webbing slots of the rebound battens to string the rebound battens together, thereby making the rebound plate to be folded and stored after disassembly. The rebound plate is composed of several rebound battens sequentially arranged to form a relatively smooth surface for soccer training, each rebound batten defines one or more webbing slots penetrating through the rebound batten, and the webbing slots of the rebound battens are used to fix the webbing, so that the webbing passes through the webbing slots of the rebound battens to string the rebound battens together.

9 Claims, 6 Drawing Sheets

PORTABLE SOCCER TRAINING DEVICE

TECHNICAL FIELD

The disclosure relates to training devices, and particularly to a portable soccer training device.

BACKGROUND

A portable soccer training device is a training device for improving soccer skills and ball control ability. Players can practice catching or controlling a ball by kicking the ball to a ball rack and bouncing the ball back. A primary objective of the portable soccer training device is to help the players enhance their passing, shooting, ball control, and catching skills. The players can practice these skills repeatedly by constantly kicking the ball to the training device, thereby improving their reaction speed and accuracy. The portable soccer training device is particularly suitable for individual training or self-practice, and can also be used for specific skill training in team training.

At present, there is the following problem in the market: the current soccer training devices are not portable.

The disclosure aims to provide a soccer training device with better portability to solve the above problem.

SUMMARY

The disclosure aims to provide a soccer training device with better portability, including a frame body and a rebound plate. The frame body and the rebound plate are detachably connected to facilitate assembly and disassembly. The rebound plate is composed of several rebound battens sequentially arranged, so that a relatively smooth surface for soccer training is formed. Each rebound batten defines one or more webbing slots penetrating through the rebound batten, and the webbing slots of the rebound battens are configured to fix a webbing, so that the webbing passes through webbing slots to string all the rebound battens together. Through above design, the rebound plate can be relatively facilitated to disassemble and can also be folded and stored, which is very convenient when temporary movement or storage is needed.

A portable soccer training device includes a frame body and a rebound plate, the rebound plate is detachably connected to a side of the frame body, the rebound plate is composed of several rebound battens sequentially arranged, and each rebound batten defines at least one webbing slot penetrating through the rebound batten. A webbing passes through the webbing slots of the rebound battens to string all the rebound battens together, thereby making the rebound plate to be folded and stored after disassembly.

In an embodiment, an end of each rebound batten is provided with a concave surface and another end of each rebound batten is provided with a convex surface, thereby making the rebound battens sequentially arranged be in close contact.

In an embodiment, the frame body includes a left frame body and a right frame body spaced apart from each other, the left frame body and the right frame body are respectively provided with installation hoops, a cross-section of each installation hoop is curved in shape, and the rebound plate and the installation hoops are connected through screws.

In an embodiment, the left frame body includes an upper beam and a lower beam spaced apart from each other, and a rear beam. Ends of the upper beam and the lower beam are connected to the installation hoop, and the rear beam is connected another end of the upper beam and another end of the lower beam, and the left frame body and the right frame body have the same structure.

In an embodiment, connecting beams are disposed between the left frame body and the right frame body, and fixedly connected the left frame body and the right frame body.

In an embodiment, the left frame body and the right frame body are provided with connecting seats configured for installing the installation hoops, and a cross-section of each connecting seat is in a "⊓" shape.

In an embodiment, limiting components are respectively disposed at bottoms of the installation hoops, a cross-section of each limiting component is in a "J" shape, and the limiting components are configured to support and limit a bottom of the rebound plate.

In an embodiment, two ends of each connecting beam are respectively provided with connecting components, a cross-section of each connecting component is in a semi-circular shape, and the connecting components are fixedly connected to the upper beams or the lower beams of the left frame body and the right frame body.

In an embodiment, the rebound battens are made of polyvinyl chloride (PVC), aluminum battens, iron sheets, or wood sheets, and each rebound batten is a hollow structure.

Compared to the related art, the beneficial effects of the disclosure are as follows: the portable soccer training device includes a frame body and a rebound plate, and the frame body and the rebound plate are detachably connected to facilitate assembly and disassembly. The rebound plate is composed of several rebound battens sequentially arranged, so that a relatively smooth surface for soccer training is formed. Each rebound batten defines one or more webbing slots penetrating through the rebound batten, and the webbing slots of the rebound battens are configured to fix a webbing, so that the webbing passes through webbing slots to string all the rebound battens together. Through above design, the rebound plate can be relatively facilitated to disassemble and can also be folded and stored, which is very convenient when temporary movement or storage is needed.

The additional aspects and advantages of the disclosure will be partially provided in the following description, and some will become apparent from the following description, or learned through the practice of the disclosure.

BRIEF DESCRIPTION OF DRAWINGS

In order to provide a clearer explanation of the embodiments of the disclosure or the technical solutions in the prior art, a brief introduction will be given to the attached drawings required in the description of the embodiments or the prior art. It is apparent that the attached drawings in the following description are only some of the embodiments of the disclosure. For those skilled in the art, other attached drawings can be obtained based on these drawings without any creative labor.

In attached drawings, description of reference signs is listed as follows:

1. frame body; 2. rebound plate; 3. rebound batten; 4. through slot; 5. left frame body; 6. right frame body; 7. installation hoop; 8. upper beam; 9. lower beam; 10. connecting beam; 11. connecting seat; 12. limiting component; 13. connecting component; 14. rear beam; 15. webbing slot; 16. webbing.

DETAILED DESCRIPTION OF EMBODIMENTS

The following will provide a clear and complete description of the technical solutions in the embodiments of the disclosure. Apparently, the described embodiments are only a part of the embodiments of the disclosure, not all of them. Based on the embodiments in the disclosure, all other embodiments obtained by those skilled in the art without creative labor fall within the scope of protection of the disclosure.

Figure 1:
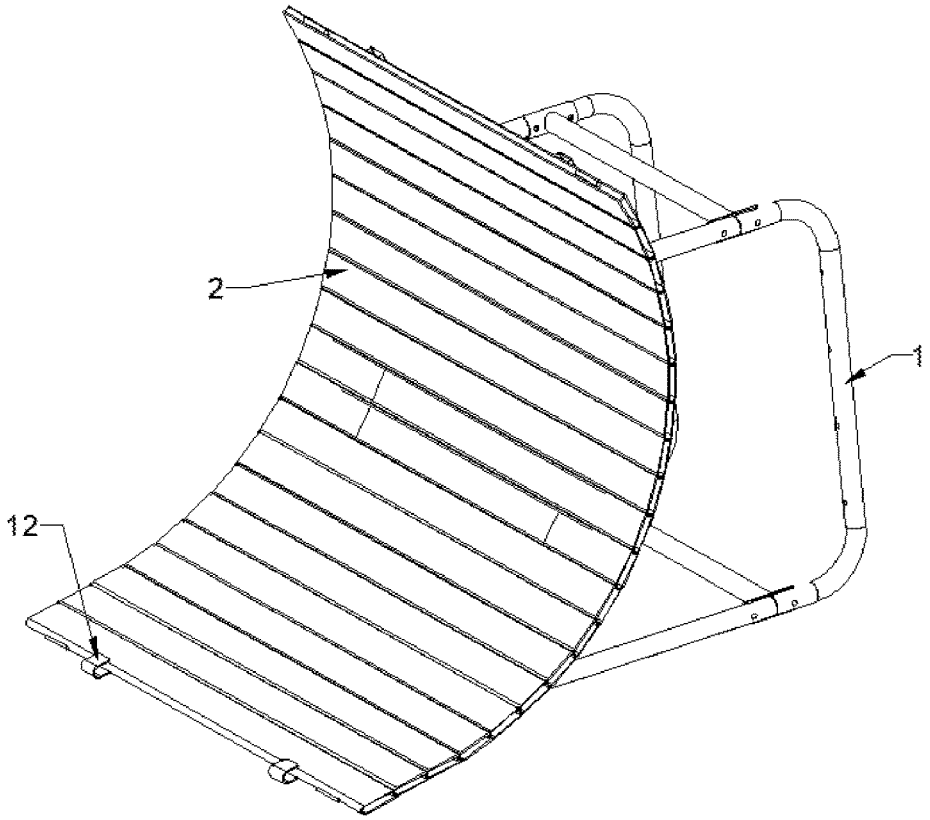
FIG. 1 illustrates a schematic structural diagram of a portable soccer training device according to the disclosure.
Figure 2:
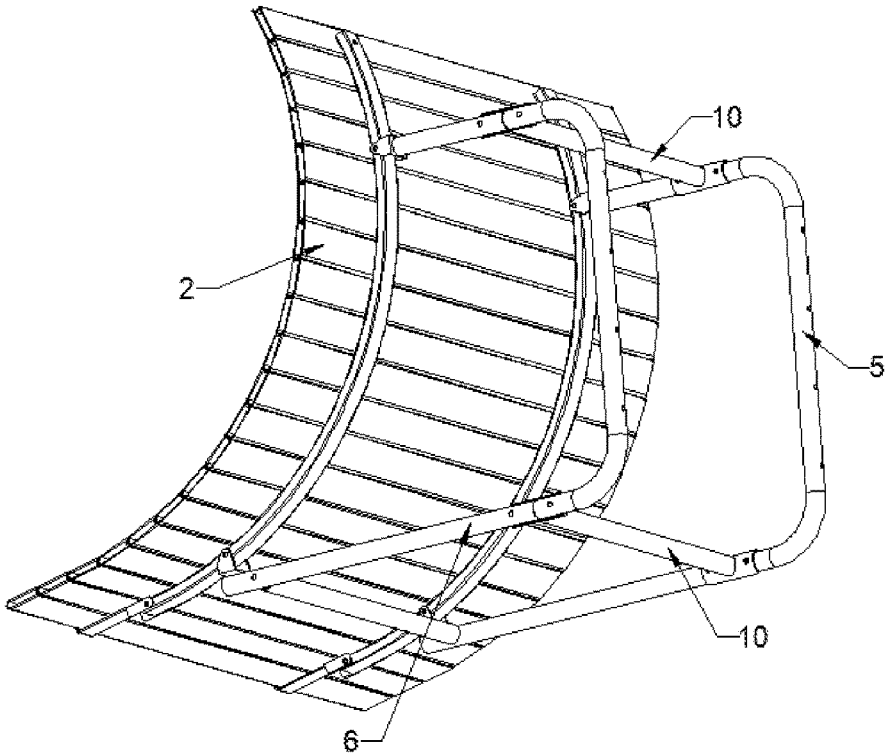
FIG. 2 illustrates a schematic structural diagram of the portable soccer training device illustrated in FIG. 1 at another angle according to the disclosure.
Figure 3:
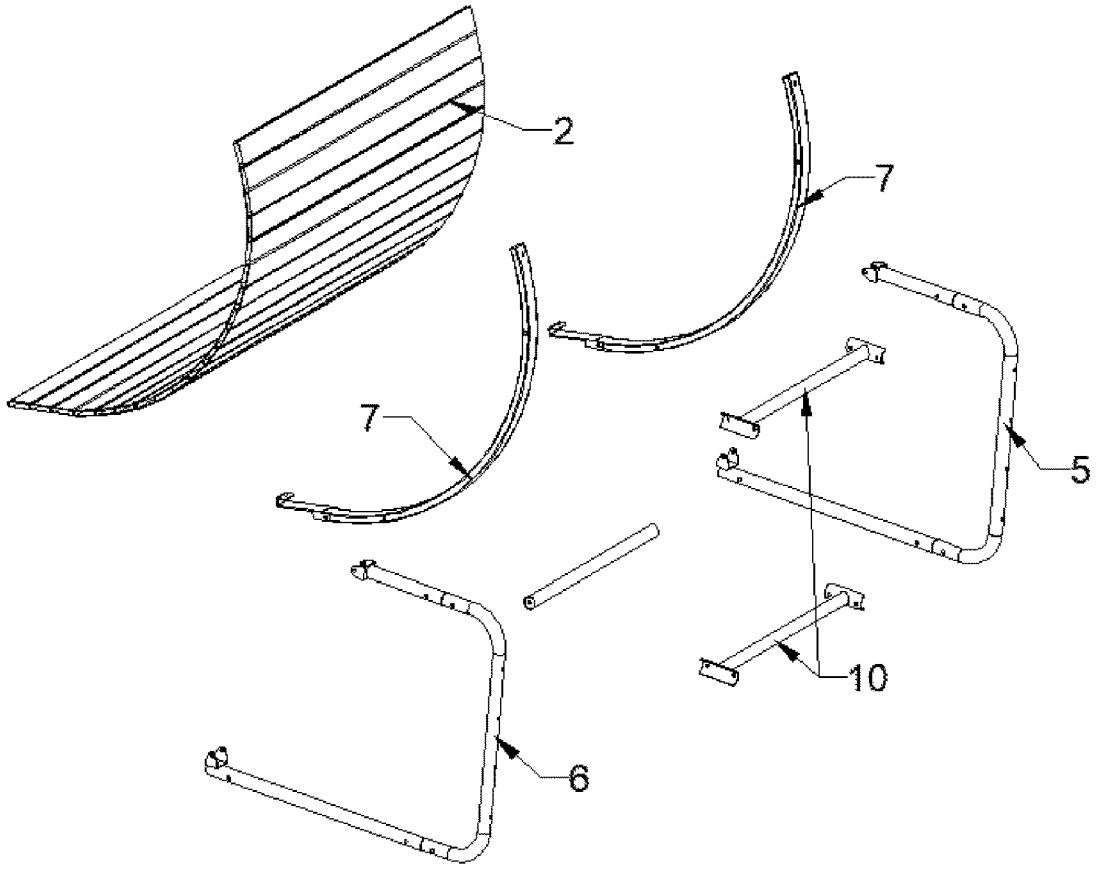
FIG. 3 illustrates a schematic exploded view of the portable soccer training device according to the disclosure.
Figure 4:
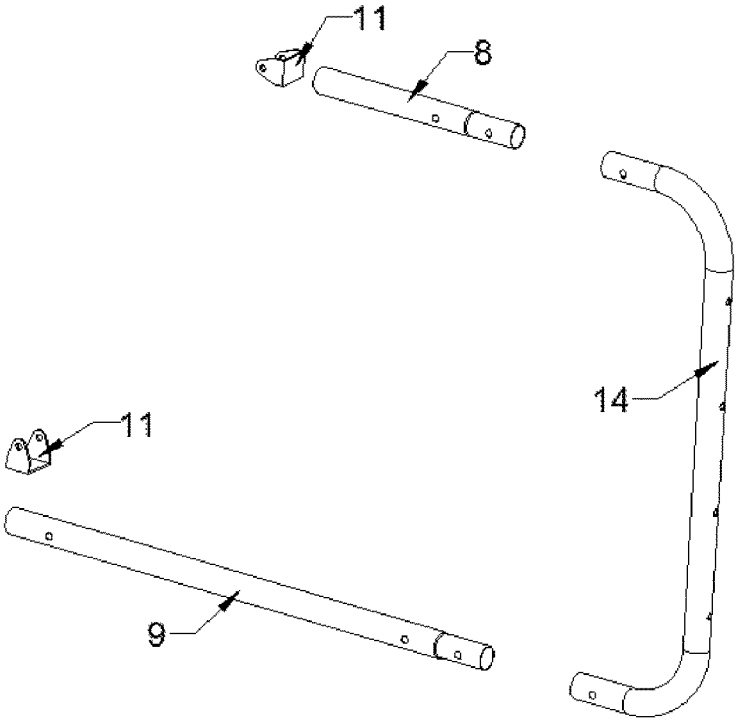
FIG. 4 illustrates a schematic exploded view of a left frame body or a right frame body according to the disclosure.
Figure 5:
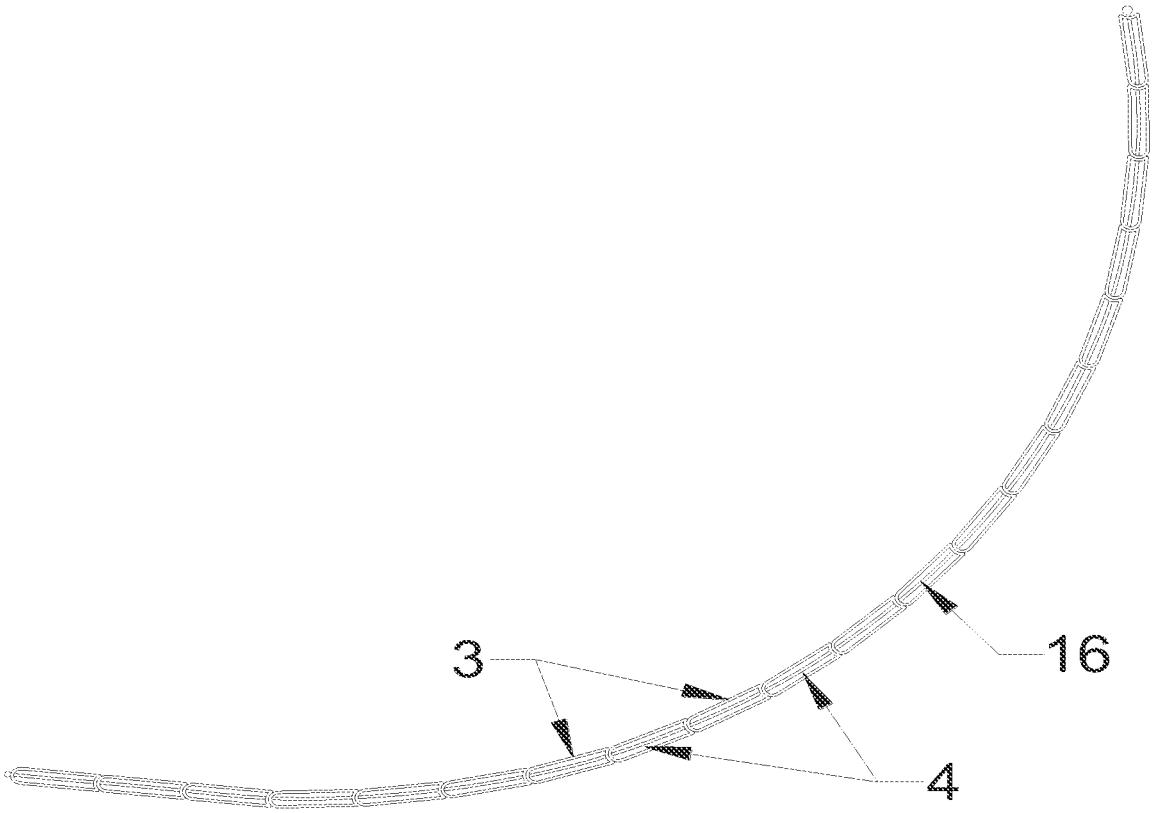
FIG. 5 illustrates a schematic structural diagram of a rebound plate according to the disclosure.
Figure 6:
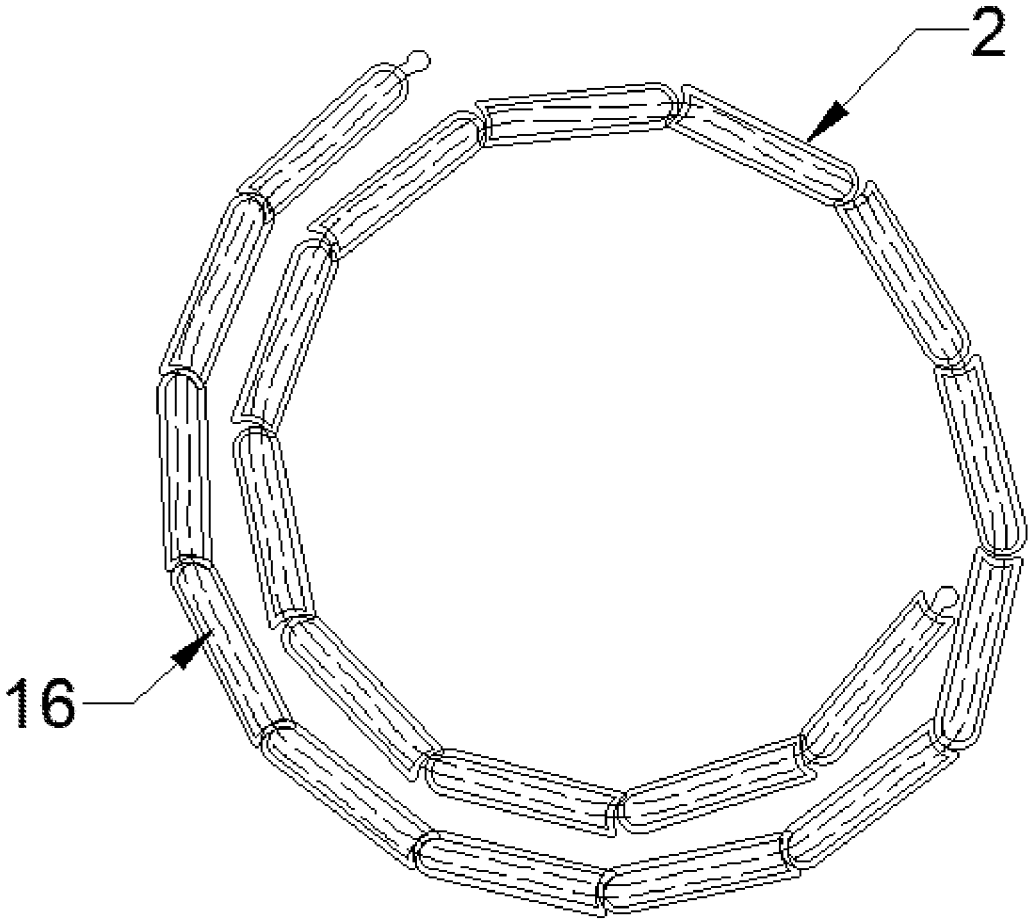
FIG. 6 illustrates a schematic structural diagram of the rebound plate after being folded according to the disclosure.
Figure 7:
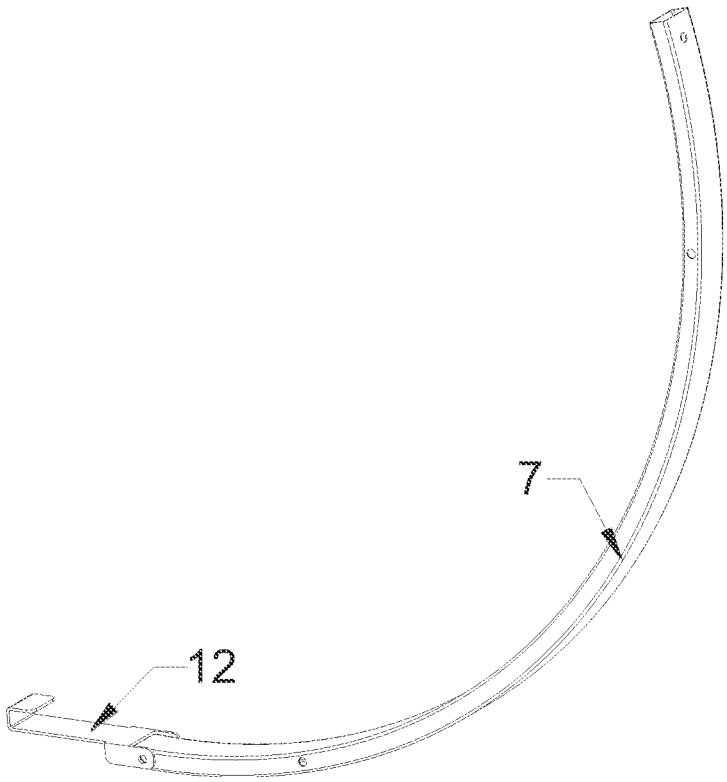
FIG. 7 illustrates a schematic structural diagram of a limiting component according to the disclosure.
Figure 8:
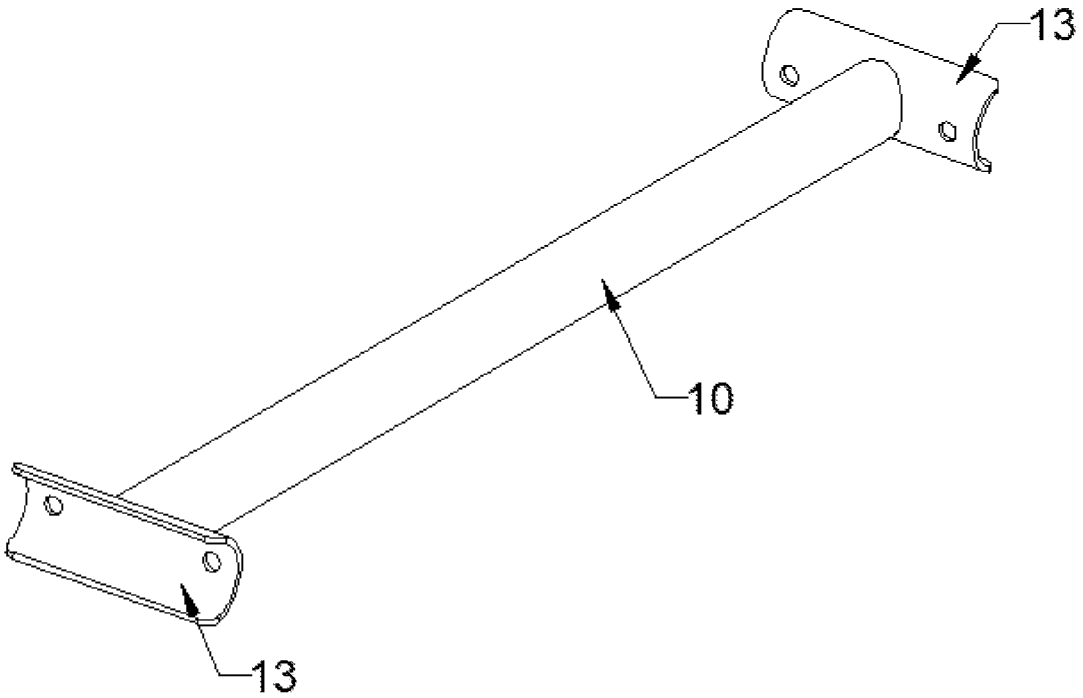
FIG. 8 illustrates a schematic structural diagram of a connecting beam according to the disclosure.
Figure 9:
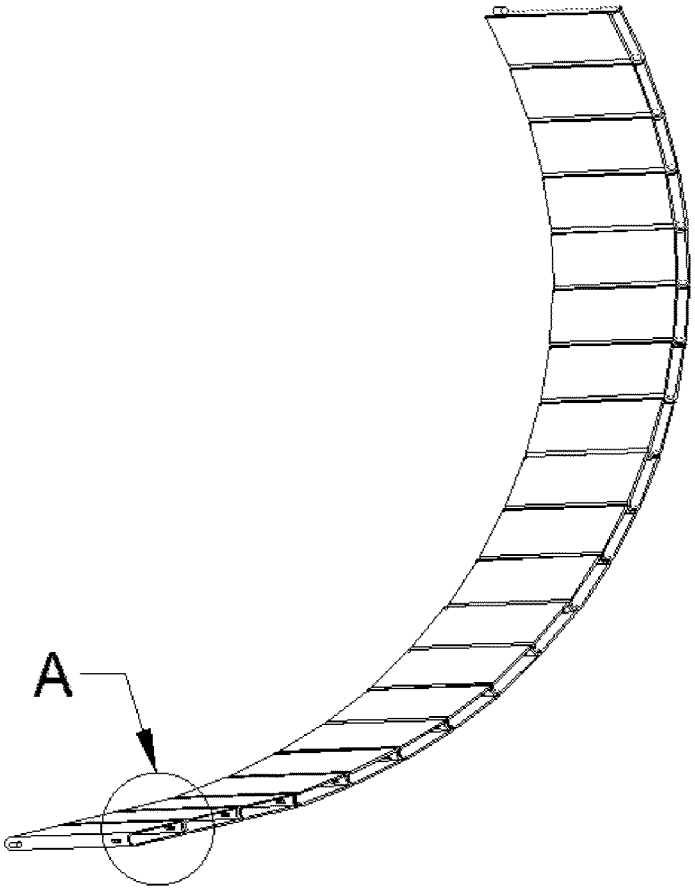
FIG. 9 illustrates a schematic structural diagram of the rebound plate illustrated in FIG. 5 at another angle according to the disclosure.
Figure 10:
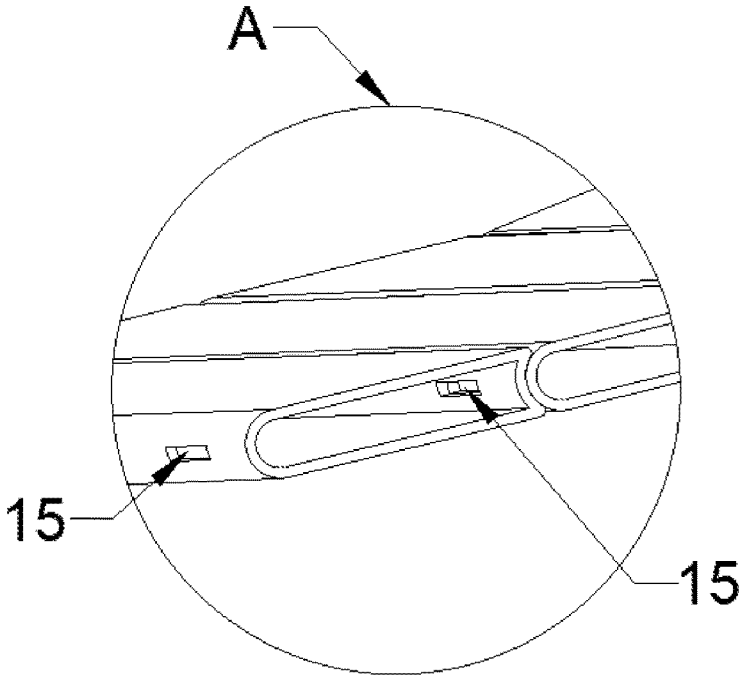
FIG. 10 illustrates a schematic enlarged view of a position A of the rebound plate illustrated in FIG. 9 according to the disclosure.

In an embodiment, referring to FIGS. 1 to 10, a portable soccer training device includes a frame body 1, a rebound plate 2 and a webbing 16, the rebound plate 2 is detachably connected to a side of the frame body 1, the rebound plate 2 is composed of several rebound battens 3 sequentially arranged, and each rebound batten 3 defines at least one webbing slot 15 penetrating through the rebound batten 3. The webbing 16 passes through the webbing slots 15 of the rebound battens 3 to string all the rebound battens 3 together, thereby making the rebound plate 2 to be folded and stored after disassembly.

In some embodiments, the frame body 1 is an integral support structure that can be composed of metals or other sturdy materials. The side of the frame body 1 is detachably connected to the rebound plate 2, the side of the frame body 1 is provided with a designed disassembly-connection device, which can easily assemble or disassemble the rebound plate 2, the rebound plate 2 can be detachably connected to the frame body 1. The rebound plate 2 is composed of several rebound battens 3 sequentially arranged, so that a relatively smooth surface for soccer training is formed. Each rebound batten 3 defines one or more webbing slots 15 penetrating through the rebound batten 3, the webbing slots 15 of the rebound battens 3 are configured to fix the webbing 16, so that the webbing 16 can penetrate through webbing slots 15 of the rebound battens 3, the webbing 16 is similar to a ribbon, which can be made of fabric or other resilient and soft materials. The webbing 16 penetrates through webbing slots 15 of the rebound battens 3 in sequence, thereby stringing all the rebound battens 3 together. Through this design, the rebound plate 2 can be relatively easy to disassemble and can also be folded and stored, which is very convenient when temporary movement or storage is needed.

In an embodiment, an end of each rebound batten 3 is provided with a concave surface and another end of each rebound batten 3 is provided with a convex surface, thereby making the rebound battens 3 sequentially arranged be in close contact.

In some embodiments, two ends of each rebound batten 3 are respectively provided with the concave surface and the convex surface, which allows the rebound battens 3 to be connected and closely contacted to each other when sequentially arranged. This design can improve a stability and a load-bearing capacity of the overall structure, while also ensuring that a surface of the rebound plate 2 is more smooth and suitable for soccer training. The training device can be quickly assembled when needed, and easily disassembled and folded for storage when not needed, providing users with great convenience and flexibility.

In an embodiment, the frame body 1 includes a left frame body 5 and a right frame body 6 spaced apart from each other, the left frame body 5 and the right frame body 6 are respectively provided with installation hoops 7, a cross-section of each installation hoop 7 is curved in shape, and the rebound plate 2 and the installation hoops 7 are connected through screws.

In some embodiments, the frame body 1 includes two parts, namely including the left frame body 5 and the right frame body 6, which are spaced apart from each other. This design can improve the stability and balance of the training device. Both the left frame body 5 and the right frame body 6 are provided with the installation hoops 7, the installation hoops 7 are disposed on the side of the frame body 1 to fix and support the rebound plate 2. The cross-section of each installation hoop 7 is curved in shape, the curved shape improves the strength of the installation hoops 7 and has some damping effect, making the rebound plate 2 smoother when receiving the ball. The rebound plate 2 is connected to the installation hoops 7 through the screws, the connection method allows the rebound plate 2 to be easily fixed on the frame body 1 and easily disassembled when needed. In a preferred embodiment, the screw connections can also allow users to adjust the height or angle of the rebound plate 2 as needed for different types of training.

In an embodiment, the left frame body 5 includes an upper beam 8 and a lower beam 9 spaced apart from each other, and a rear beam 14. Ends of the upper beam 8 and the lower beam 9 are connected to the installation hoop 7, and the rear beam 14 is connected to another end of the upper beam 8 and another end of the lower beam 9, and the left frame body 5 and the right frame body 6 have the same structure.

In some embodiments, the left frame body 5 includes the upper beam 8, the lower beam 9 and the rear beam 14, thereby a main support structure of the frame body 1 is formed. The ends of both the upper beam 8 and the lower beam 9 are connected to the installation hoop 7, ensuring the stable installation of the rebound plate 2. The rear beam 14 is disposed between the end of the upper beam 8 and the end of the lower beam 9, thereby the upper beam 8 and the lower beam 9 are connected together through the rear beam 14. This design can increase the structural strength of the frame body 1, ensuring that the training device will not be twisted or deformed during use. The right frame body 6 includes the same structure as the left frame body 5, which means that the entire training device has a symmetrical design, and two sides of the frame body 1 have the same structure. This design is conducive to maintain the balance and stability of the training device.

In an embodiment, connecting beams 10 are disposed between the left frame body 5 and the right frame body 6, and fixedly connected to the left frame body 5 and the right frame body 6.

In some embodiments, the connecting beams 10 are connected to the left frame body 5 and the right frame body 6 together, ensuring that the left frame body 5 and the right frame body 6 remain parallel and symmetrical, which is conducive to maintain the stability of the training device, so that the rebound plate 2 will not shake or sway during the training process. The connecting beams 10 also increase the structural strength of the entire training device, which is crucial for withstanding the athlete's kick and return force to ensure the long-term durability of the training device.

In an embodiment, the left frame body 5 and the right frame body 6 are provided with connecting seats 11 configured for installing the installation hoops 7, and a cross-section of each connecting seat 11 is in a "┌┐" shape.

In some embodiments, both the left frame body 5 and the right frame body 6 are provided with the connecting seats 11, the connection seats 11 are disposed on the side of the frame body 1 and are configured for installing the installation hoops 7. The installation hoops 7 are connected to the left frame body 5 or the right frame body 6 through the connecting seats 11, the connection methods may include screws, pins, or other appropriate connection methods to ensure that the rebound plate 2 is firmly fixed on the frame body 1. The cross-section of each connecting seat 11 is in the "┌┐" shape, which is conducive to increase the stability and support capacity of the connecting seats 11, the "┌┐" shape can provide a larger surface area to withstand the pressure of the rebound plate 2 and reduce stress concentration at the connection.

In an embodiment, limiting components 12 are respectively disposed at bottoms of the installation hoops 7, a cross-section of each limiting component 12 is in a "J" shape, and the limiting components 12 are configured to support and limit a bottom of the rebound plate 2.

In some embodiments, a bottom of each installation hoop 7 is provided with a limiting component 12. The limiting components 12 are respectively disposed at the bottoms of the installation hoops 7 and can be connected to installation hoops 7 themselves through the fixing screws or other connection methods. The cross-section of each limiting component 12 is in the "J" shape, which can provide reliable support and limit functions, the "J" shaped cross-section of the limiting components 12 can effectively wrap around the bottom of the rebound plate 2, ensuring that the rebound plate 2 maintains the correct position during the training process. The main function of the limiting components 12 is to support and limit the movement of the rebound plate 2, and the limiting components 12 prevent the rebound plate 2 from sliding or shaking, ensuring that the soccer bounces correctly on the rebound plate 2, thereby providing a stable training environment.

In an embodiment, two ends of each connecting beam 10 are respectively provided with connecting components 13, a cross-section of each connecting component 13 is in a semi-circular shape, and the connecting components 13 are fixedly connected to the upper beams 8 or the lower beams 9 of the left frame body 5 and the right frame body 6.

In some embodiments, the two ends of each connecting beam 10 are respectively provided with the connecting components 13, the connecting components 13 are disposed at ends of the connecting beam 10 and are used to connect the connecting beam 10 with the upper beams 8 or the lower beams 9 of the left frame body 5 and the right frame body 6, as well as other related components. The cross-section of each connecting components 13 is in the semi-circular shape, which may increase the stability and support capacity of the connecting components 13, and the cross-section shape of the semi-circular can provide a larger surface area to withstand connection forces and reduce stress concentration at the connection. The connecting components 13 are fixedly connected to the upper beams 8 or the lower beams 9 of the left frame body 5 and the right frame body 6 by usually using the screws, nuts, pins, or other appropriate connection methods to ensure that the connecting beams 10 are firmly fixed on different parts of the frame body 1.

In an embodiment, the rebound battens 3 are made of PVC, aluminum battens, iron sheets, or wood sheets, and each rebound batten 3 is a hollow structure.

In some embodiments, the rebound battens 3 can be made of one of the following materials: PVC, aluminum battens, iron sheets, and wood sheets, each material has its unique characteristics and uses. For example, PVC has good durability and toughness, aluminum battens are lighter and have a certain strength, iron sheets can provide higher load-bearing capacity, and wood sheets may provide a natural appearance and texture. The interior of the each rebound batten 3 is hollow structure, rather than a solid structure, which can reduce the weight of the overall structure while maintaining sufficient stability and strength, to ensure that the structure has sufficient stability and load-bearing capacity while maintaining relative lightness, making the training device very practical for mobile or temporary use.

For those skilled in the art, it is evident that the disclosure is not limited to the details of the exemplary embodiments mentioned above, and can be implemented in other specific forms without departing from the spirit or basic features of the disclosure. Therefore, from any perspective, the embodiments should be regarded as exemplary and non-restrictive. The scope of the disclosure is limited by the accompanying claims rather than the above description. Therefore, the aim is to include all changes within the meaning and scope of the equivalent elements of the claims within the disclosure.

What is claimed is:

1. A soccer training device, comprising:

a frame body;

a rebound plate, detachably connected to a side of the frame body; wherein the rebound plate is composed of rebound battens sequentially arranged, and each rebound batten defines at least one webbing slot penetrating through the rebound batten; and a webbing, passing through the webbing slots of the rebound battens to string the rebound battens together, thereby making the rebound plate to be folded and stored after disassembly.

2. The soccer training device as claimed in claim 1, wherein an end of each rebound batten is provided with a concave surface and another end of each rebound batten is provided with a convex surface, thereby making the rebound battens sequentially arranged be in close contact.

3. The soccer training device as claimed in claim 1, wherein the frame body comprises a left frame body and a right frame body spaced apart from each other, the left frame body and the right frame body are respectively provided with installation hoops, a cross-section of each installation hoop is curved in shape, and the rebound plate and the installation hoops are connected through screws.

4. The soccer training device as claimed in claim 3, wherein the left frame body comprises an upper beam and a lower beam spaced apart from each other, and a rear beam;

ends of the upper beam and the lower beam are connected to the installation hoop, and the rear beam is connected to another end of the upper beam and another end of the lower beam;

and the left frame body and the right frame body have the same structure.

5. The soccer training device as claimed in claim 3, wherein connecting beams are disposed between the left frame body and the right frame body, and fixedly connected to the left frame body and the right frame body.

6. The soccer training device as claimed in claim 5, wherein two ends of each connecting beam are respectively provided with connecting components, a cross-section of each connecting component is in a semi-circular shape, and the connecting components are fixedly connected to upper beams or lower beams of the left frame body and the right frame body.

7. The soccer training device as claimed in claim 3, wherein the left frame body and the right frame body are provided with connecting seats configured for installing the installation hoops, and a cross-section of each connecting seat is in a "ㄱ" shape.

8. The soccer training device as claimed in claim 3, wherein limiting components are respectively disposed at bottoms of the installation hoops, a cross-section of each limiting component is in a "J" shape, and the limiting components are configured to support and limit a bottom of the rebound plate.

9. The soccer training device as claimed in claim 1, wherein the rebound battens are made of polyvinyl chloride (PVC), aluminum battens, iron sheets, or wood sheets, and each rebound batten is a hollow structure.

* * * * *